United States Patent [19]

Sugiura et al.

[11] 4,248,200

[45] Feb. 3, 1981

[54] IGNITION SYSTEM FOR INTERNAL COMBUSTION ENGINE

[75] Inventors: Noboru Sugiura, Katsuta; Seiji Suda, Mito, both of Japan

[73] Assignee: Hitachi, Ltd., Japan

[21] Appl. No.: 44,998

[22] Filed: Jun. 4, 1979

[30] Foreign Application Priority Data

Jun. 2, 1978 [JP] Japan ..... 53/65766

[51] Int. Cl.[3] ..... F02P 3/04

[52] U.S. Cl. ..... 123/644; 123/645

[58] Field of Search ..... 123/148 E

[56] References Cited

U.S. PATENT DOCUMENTS

| | | | |
|---|---|---|---|
| 3,882,840 | 5/1975 | Adamian et al. | 123/148 E |
| 4,008,698 | 2/1977 | Gartner | 123/148 E X |
| 4,019,484 | 4/1977 | Mori | 123/148 E |
| 4,030,468 | 6/1977 | Sugiura et al. | 123/148 E |
| 4,153,032 | 5/1979 | Chateau | 123/148 E |

*Primary Examiner*—Tony M. Argenbright

*Attorney, Agent, or Firm*—Craig and Antonelli

[57] ABSTRACT

A power transistor is connected in series with a DC power supply and the primary winding of an ignition coil. The base of the power transistor is connected to first and second transistors connected in compound fashion. A current limiter circuit is operated when the current in the primary winding reaches a predetermined value, thus controlling the first transistor. The second transistor is controlled by and the current thereof limited by the first transistor on the one hand and on the other hand subjects the power transistor to on-off control in accordance with the ignition timing signal synchronous with the engine r.p.m.

4 Claims, 4 Drawing Figures

IGNITION SYSTEM FOR INTERNAL COMBUSTION ENGINE

The present invention relates to an ignition system for the internal combustion engines or more in particular to an improvement in the ignition system for internal combustion engines which has a current limiter circuit for limiting the current flowing in the ignition coil to a predetermined value.

In the ignition system for the internal combustion engines, the primary winding of the ignition coil and a power transistor are connected in series between the output terminals of a battery, and this power transistor is turned on and off by an ignition timing signal in synchronism with the revolutions of the internal combustion engine, thus generating a high voltage across the secondary winding of the ignition coil. In order to produce a high voltage suitable for the spark plug, it is necessary that a current of a predetermined magnitude flows through the primary winding of the ignition coil.

If the current in the primary winding is larger than the amount required for generation of a voltage suitable for the spark plug or if the current in the primary winding flows for a period longer than necessary, however, more power than necessary is consumed from the battery.

It is well known that in order to avoid this waste of power, the base current of the power transistor is reduced when the primary current reaches a predetermined value, thus limiting the current in the power transistor to a predetermined value. Such a system is disclosed in U.S. Pat. No. 4,030,468 assigned to Sugiura et al on June 21, 1977.

In the above-mentioned system, the power transistor is controlled to three conditions in response to the base current supplied from a driver transistor in the previous stage which operates in accordance with the ignition timing signal. First, soon before an ignition timing, a sufficiently high voltage is applied between the base and emitter of the power transistor, so that a sufficiently large base current flows, thus turning on the power transistor. In the process, the power transistor operates in the saturation region so that the collector current is saturated. As a result, a current flows through the primary winding from the battery, which current rises in accordance with the circuit constant. When the current in the primary winding reaches a predetermined value, the current limiter circuit is actuated, and a signal corresponding to the primary winding current is fed back to the driver transistor provided in the stage previous to the power transistor. The driver transistor is for reducing the base current of the power transistor in accordance with the amount of feedback thereby to hold the primary winding current at a predetermined value. Under this condition, the power transistor operates in an active region and the collector current thereof changes in accordance with the base current. Therefore, this condition is called a non-saturation. When a transistor is on under the non-saturated condition, it is conducting. Thus such a condition may hereinafter be called a conductive state.

At an ignition timing, the voltage between base and emitter of the power transistor is reduced substantially to zero. As a result, the power transistor transfers from the non-saturated condition to a turned off state, so that a high voltage is generated across the secondary winding of the ignition coil. Although this ignition system avoids waste of the battery power, it is impossible to attain a high gain and it is necessary to increase the output level of the current limiter circuit in view of the fact that a signal corresponding to the ignition timing signal and a feedback signal from the current limiter circuit are directly applied to the driver transistor in the stage preceding the power transistor. This system is accompanied by so great a heat generation in the current limiter circuit that it cannot suitably be produced in integrated circuits.

Accordingly, it is an object of the present invention to provide an ignition system for the internal combustion engines which is adapted to be produced in integrated circuits.

Another object of the present invention is to provide an ignition system for the internal combustion engines which is low in heat generation in the system, especially, in the current limiter circuit.

Still another object of the present invention is to provide an ignition system for the internal combustion engines in which the operating time of the power transistor within the non-saturation region is easily regulated.

According to one aspect of the present invention, there is provided an ignition system for the internal combustion engines, comprising a driver circuit including first and second transistors connected with each other in compound fashion, the current limiting signal from the current limiter circuit being applied to the first transistor, the ignition timing signal being applied to the second transistor.

The above and other objects, features and advantages will be made apparent by the detailed description taken in conjunction with the accompanying drawings, in which.

Figure 1:
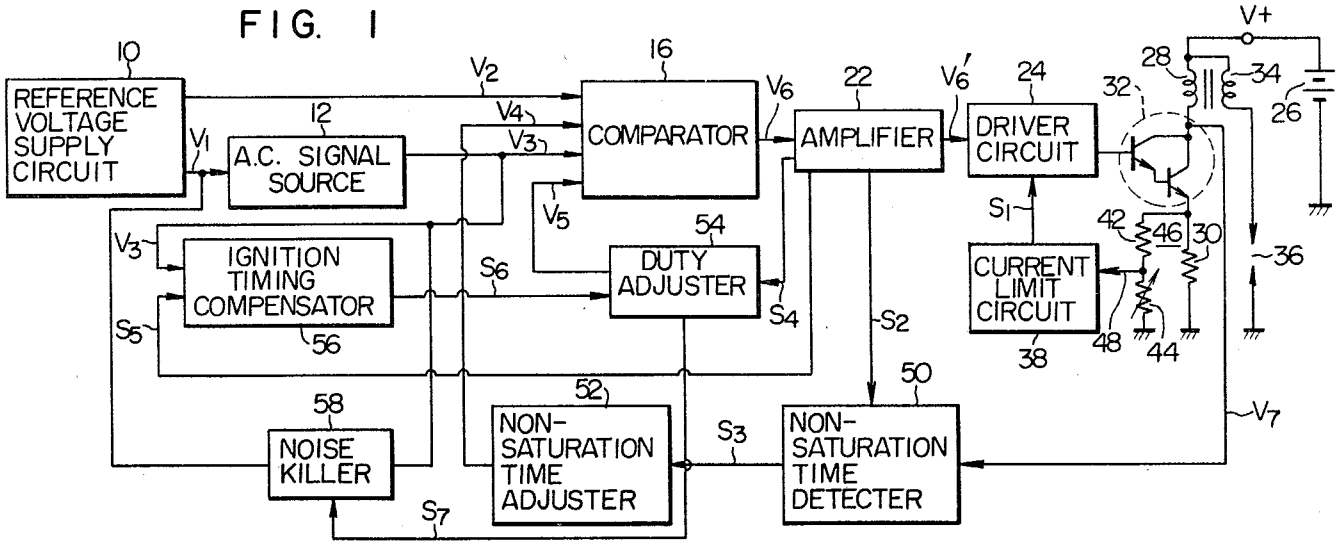
FIG. 1 is a block diagram showing an embodiment of the present invention.

The block diagram of FIG. 1 shows an embodiment of the present invention. A reference voltage supply circuit 10 supplies predetermined voltages $V_1$ and $V_2$ to an AC voltage signal source 12 and a comparator 16 respectively. The AC voltage signal source 12 generates an AC voltage signal $V_3$ synchronous with the engine r.p.m. which signal is applied to the comparator 16. The comparator 16 compares a reference voltage which is the sum of the voltage $V_2$ from the reference voltage supply circuit 10 and the voltage signal $V_4$ representing the non-saturation time with the sum of the voltage signal $V_3$ of the AC voltage signal source 12 and the duty adjusting signal $V_5$, and produces a rectangular wave output $V_6$. The amplifier 22 amplifies the rectangular wave output $V_6$ and produces an output $V_6'$ to the driver circuit 24 as an ignition timing signal. The power transistor 32 connected in series with the DC power supply 26, the primary winding 28 of the ignition coil and the resistor 30 is turned on or off or placed in non-saturated condition in accordance with the output level of the driver circuit 24. When the power transistor 32 is on, the current flows from the DC power supply 26 through the primary winding 28; and when it is turned off, the current from the DC power supply 26 is cut off. When the power transistor 32 is in non-saturated condition, the current flowing in the primary winding 28 is limited to a predetermined value.

At the time when the power transistor 32 is turned off, the high voltage generated across the secondary winding 34 of the ignition coil is applied to the spark plug 36. The current limiter circuit 38 is connected to the output terminal 48 of the current detector 46 including resistors 30 and 42 and a variable resistor 44 and supplies a current limiting signal $S_1$ to the driver circuit 24 when the current in the primary winding 28 reaches a predetermined value. The output level of the driver circuit 24 is changed by the current limiting signal $S_1$ with the result that the power transistor 32 is transferred from on state to non-saturated condition, and thus the current in the primary winding 28 is maintained at a predetermined value. This predetermined value of the primary winding current is adjustable by the variable resistor 44.

The non-saturation time detector 50 operates in response to the collector potential of the power transistor 32 and the output signal $S_2$ of the amplifier 22. The output signal $S_2$ of the amplifier 22 is produced only when the power transistor is on or in a non-saturated condition. The non-saturation time detector 50 generates an output signal $S_3$ only when the collector potential $V_7$ is sufficiently high and the signal $S_2$ is produced. When the power transistor 32 is off or in non-saturated condition, the collector voltage thereof $V_7$ is high and therefore the output signal $S_3$ is produced only during the time Ts when the power transistor 32 is in non-saturated condition.

The output signal $S_3$ representing the non-saturation time is converted into the voltage signal $V_4$ by the non-saturation time adjuster 52 and applied to the comparator 16 as a non-saturation time signal.

The rectangular wave output signal $S_4$ of the amplifier 22 is applied to the duty adjuster 54 where it is converted into a voltage $V_5$ proportional to the engine r.p.m. In response to the output signal $S_5$ of the amplifier 22 and the output signal $V_3$ of the AC voltage signal source 12, the ignition timing compensator 56 produces a signal $S_6$ for several 100 μsec after generation by the amplifier 22 of a signal for turning off the power transistor 32 or when the output voltage $V_3$ of the AC voltage signal source 12 is higher than a predetermined value.

The duty adjuster 54 maintains the output voltage of 0 volt as long as it is supplied with the signal $S_6$ from the ignition timing compensator 56.

In response to the output signal $S_7$ of the duty adjuster 54, the noise killer 58 short-circuits the AC voltage signal source 12 for a short period of time upon generation of a signal for turning off the power transistor 32 as explained later.

Figure 2A:
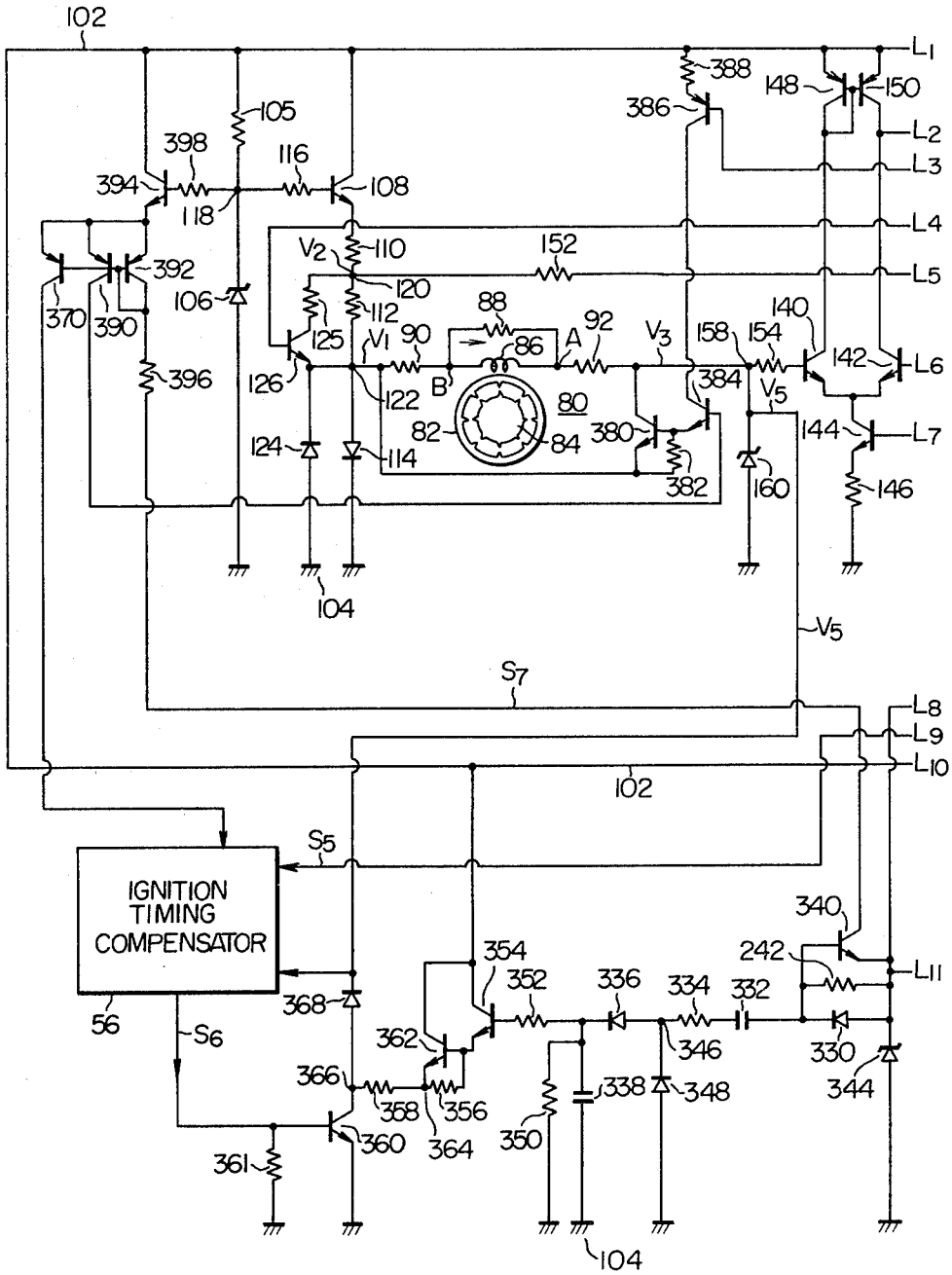
FIGS. 2A and 2B are diagrams showing an electrical circuit of an embodiment of the present invention.
Figure 2B:
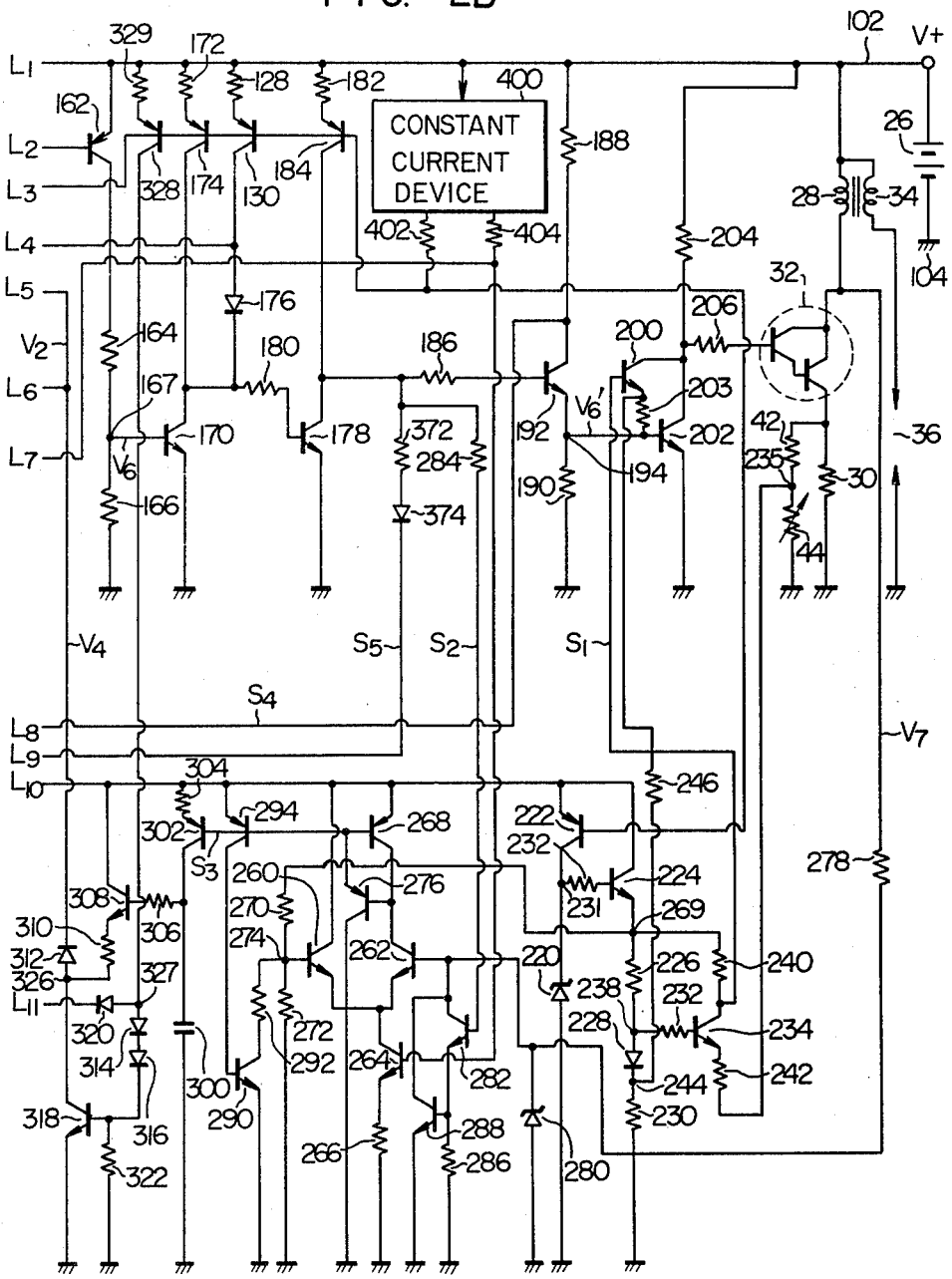

FIG. 2 is an electrical circuit diagram of an embodiment of the present invention shown in FIG. 1. The configuration of each part of the circuit will be described below.

(1) AC voltage signal source

The AC voltage signal source 12 is, for example, a pick-up of variable magnetic reactance type well known in the automobile industry. This pick-up has a rotor member 84 rotating in the bore of the magnetic pole piece 82 in synchronism with the internal combustion engine. The magnetic pole piece 82 is made of a permanent magnet.

Figure 3:
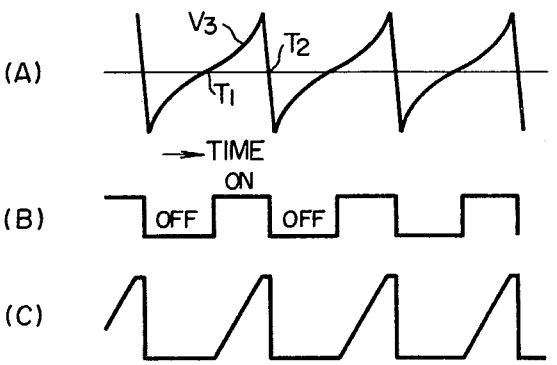
FIG. 3 shows waveforms of the AC voltage signal, the output signal of a comparator and the primary winding current in FIG. 2.

A series of protrusions, the same in number as the cylinders of the internal combustion engine, are formed at regular intervals on the outer periphery of the rotor member 84 and the inner periphery of the magnetic pole piece 82. Depending on whether each of the protrusions of the rotor member 84 approaches to or moves away from each of the protrusions of the magnetic pole piece 82, the magnetic reactance of the magnetic path between the rotor member 84 and the magnetic pole piece 82 is reduced or increased respectively. As a result, an AC voltage signal $V_3$ as shown by the waveform of FIG. 3A is generated in the pick-up coil 86 coupled to the magnetic pole piece 82 magnetically. This AC voltage signal is synchronous with the engine r.p.m. and is used for determining the ignition timing. The pick-up coil 86 is connected in parallel with the resistor 88 and in series with the resistors 90 and 92.

(2) Reference voltage supply circuit

A resistor 105 and a zener diode 106 are connected in series between the positive terminal 102 of the DC power supply 26 and the grounding terminal 104. The collector-emitter circuit of the transistor 108 is connected in series with the resistors 110 and 112 and the diode 114, while the base thereof is connected through a resistor 116 to the junction point 118 of the resistor 105 and the zener diode 106. The base-emitter voltage of the transistor 108 is maintained constant by the zener diode 106, so that the current in the collector-emitter circuit of the transistor 108 remains substantially the same regardless of a change in the source voltage, thus maintaining constant the voltage $V_2$ at the junction point of the resistor 110 and the resistor 112 and the junction point 122 of the resistor 112 and the diode 114. The diode 114 is connected in reversed parallel with the diode 124 forming a bypass of the surge voltage 122. The resistor 112 is connected in parallel to the collector-emitter circuit of the transistor 126 through the resistor 125, and the base of the transistor 126 is connected to the positive terminal 102 of the DC power supply via the resistor 128 and the transistor 130.

(3) Comparator

The emitters of the transistors 140 and 142 are connected with each other, and through the collector-emitter circuit of the transistor 144 and the resistor 146, connected to the grounding terminal 104 of the DC power supply. The collectors of the transistors 140 and 142 are connected to the positive terminal 102 of the DC power supply via the transistors 148 and 150, the bases of which are connected to the collector of the transistor 140. The base of the transistor 142 is connected through the resistor 152 to the junction point 120 of the resistors 110 and 112 in the reference voltage supply circuit 10.

The base of the transistor 140 is connected via the resistor 154 to one terminal of the resistor 92 of the AC voltage signal source 12. A protective zener diode 160 is connected between the junction point 158 of the resistors 154 and 82 and the grounding terminal 104. The base of the transistor 140 is impressed with the AC voltage signal $V_3$ and the duty adjusting signal $V_5$, while the base of the transistor 142 is impressed with the non-saturation timing signal $V_4$ and a constant voltage $V_2$. The transistor 140 is turned on when $V_3+V_5 \geqq V_2+V_4$.

The emitter-collector circuit of the transistor 162 is connected in series with the resistors 164 and 166 between the DC power supply terminals 102 and 104. The base of the transistor 162 is connected to the collector of the transistor 142.

(4) Amplifier

The base of the transistor 170 is connected to the junction point 161 of the resistors 164 and 166 of the comparator 16, and the collector thereof is connected to the positive terminal 102 of the DC power supply via a constant current circuit including a resistor 172 and a transistor 174. Further, the collector of the transistor 170 is connected to the collector of the transistor 130 in the reference voltage supply circuit 10 via the diode 176.

The transistor 178 is provided for amplifying the output of the transistor 170. The base of the transistor 178 is connected to the collector of the transistor 170 through the resistor 180, and the collector-emitter circuit thereof is connected to the positive terminal 102 of the DC power supply via a constant current circuit including a resistor 182 and a transistor 184.

The output of the transistor 178 is amplified by an amplifier circuit including resistors 186, 188, 190 and a transistor 192. The transistors 170, 178 and 192 are switching transistors. Upon the turning off of the transistor 170, the transistor 178 is turned on and the transistor 192 is turned off, while upon turning on of the transistor 170, the transistor 178 is turned off and the transistor 192 is turned on, so that an amplified output is produced at the output terminal 194 of the transistor 192.

(5) Driver circuit

First and second transistors 200 and 202 are connected in compound fashion. In other words, the collectors of the transistors 200 and 202 are connected with each other, and the emitter of the transistor 200 is connected via a resistor 203 to the base of the transistor 202. The base of the transistor 202 is connected to the output terminal 94 of the amplifier 22, and the collector thereof is connected via the resistor 104 to the positive terminal 102 of the DC power supply. The base of the transistor 200 is supplied with the output $V_6'$ of the amplifier 22 as an ignition timing signal, and the transistor 202 is supplied with the current limiting signal $S_1$ independently of the voltage $V_6'$. The transistor 202 normally operates in accordance with the output of the amplifier 22. With the increase in the conduction of the transistor 200, however, the transistor 202 comes to operate in active fashion (i.e., in non-saturated fashion). The collector of the transistor 202 is connected via the resistor 206 to the base of the transistor 32.

(6) Current limiting circuit

The emitter-collector circuit of the transistor 222 and the zener diode 220 are inserted between the grounding terminal 104 and the positive terminal 102 of the DC power supply. Further, the collector-emitter circuit of the transistor 224, the resistor 226, the diode 228 and the resistor 230 are connected in series between the positive terminal and the grounding terminals 102 and 104 of the DC power supply. The base of the transistor 224 is connected via the resistor 232 to the junction point 231 of the zener diode 220 and the transistor 222. The resistor 232 is for preventing the oscillation of the transistor 224. The collector of the transistor 234 is connected to the emitter of the transistor 224 via the resistor 240. Further, the same collector is connected to the base of the first transistor 200 of the driver circuit 24.

The emitter of the transistor 234 is connected via the resistor 242 to the junction point 235 of the resistors 42 and 44 of the current detector. The resistor 242 is for preventing the excess current from flowing through the transistor 234 when the potential of the junction point 235 is reduced to negative level by a surge voltage. The diode 228 connected via the resistor 232 to the base of the transistor 234 is for temperature compensation of the transistor 234.

The junction point 244 of the resistor 230 and the diode 228 is connected to the emitter of the first transistor 200 of the driver circuit 24 through the resistor 246 for negatively feeding back the collector-emitter current of the first transistor 200 to the current limiter circuit 38, thus preventing the undesirable oscillation. More specifically, with the increase in the collector-emitter current of the first transistor 200 of the driver circuit 24, the voltage drop across the resistor 203 increases, thus increasing the voltage fed back to the junction point 244 through the resistor 246. As a result, the base voltage of the transistor 234 is increased, resulting in an increased collector-emitter current. The increase in the collector-emitter current of the transistor 234 causes a decrease in the current limiting signal $S_1$ of the current limiter circuit, i.e., the collector voltage of the transistor 234. Thus the base voltage of the first transistor 200 is reduced, so that the collector-emitter current thereof is decreased.

(7) Non-saturation time detector

The emitters of the two transistors 260 and 262 are connected to each other and also to the grounding terminal 104 of the DC power supply through the collector-emitter circuit of the transistor 264 and the resistor 266. The collector of the transistor 260 is connected to the positive terminal 102 of the DC power supply, while the collector of the transistor 262 is connected to the positive terminal 102 through the transistor 268.

Resistors 270 and 272 are connected in series between the grounding terminal 104 and the junction point in the current limiter circuit 38, the junction point 274 of which is connected to the base of the transistor 260 to supply a reference voltage to the transistor 260. Since the potential at the junction point 269 is maintained constant by the zener diode 220, the base of the transistor 260 is supplied with a substantially constant voltage.

The emitter-base circuit of the transistor 276 is connected in parallel to the base-collector circuit of the transistor 268, and the collector thereof is connected to the grounding terminal 104. The base of the transistor 262 is impressed with the collector potential $V_7$ of the power transistor 32 through the resistor 278. When this collector potential exceeds a predetermined level, the zener diode 280 begins to conduct thereby protecting the circuit.

The base of the transistor 282 is connected through the resistor 284 to the collector of the transistor 178 in the amplifier 22, while the emitter of the transistor 282 is grounded through the resistor 286. The collector of the transistor 282 is connected to the collector of the transistor 288 and the base of the transistor 262. The base and emitter of the transistor 288 are connected to the grounding terminal 104 and the emitter of the transistor 282 respectively.

The collector-emitter circuit of the transistor 290 and the resistor 292 are connected across the resistor 272, while the base of the transistor 290 is supplied with a current through the transistor 294.

(8) Non-saturation time adjuster

The capacitor 300, the emitter-collector circuit of the transistor 302 and the resistor 304 are inserted between the positive terminal 102 of the DC power supply and the grounding terminal 104. The transistor 302 is turned on only when the power transistor 32 is in non-saturated condition, and therefore the charge voltage of the capacitor 300 is substantially proportional to the non-saturation time Ts of the power transistor 32.

The collector of the transistor 302 is connected to the base of the transistor 142 of the comparator 16 through the resistor 306, the base-emitter circuit of the transistor 308, the resistor 310 and the diode 312. The diodes 314 and 316 are connected in series with each other, and the cathode of the diode 316 is connected to the base of the transistor 318. The anode of the diode 314, on the other hand, is connected to the anode of the diode 320. The cathode of the diode 320 is connected to the collector of the transistor 192. The base of the transistor 318 is grounded through the resistor 322.

The junction point 326 of the diode 312 and the resistor 310 is connected to the earth through the collector-emitter circuit of the transistor 318. The junction point 327 of the diodes 320 and 314 is connected to the positive terminal 102 of the DC power supply through the transistor 328 and the resistor 329.

(9) Duty adjuster

In order to produce a signal in accordance with the revolutional speed of the engine, a diode 330, a capacitor 332, a resistor 334, a diode 336, and a capacitor 338 are inserted in series between the collector of the transistor 192 and the grounding terminal 104. The base-emitter circuit of the transistor 340 and the resistor 342 are connected in parallel to the diode 330. The zener diode 344 is inserted between the grounding terminal and the anode of the diode 330 to protect the circuit from an excess voltage.

In order to discharge the electron charges of the capacitors 332 and 338, a diode 348 is inserted between the grounding terminal 104 and the junction point 346 of the resistor 334 and the diode 336 on the one hand and a discharge resistor 350 is connected in parallel to the capacitor 338 on the other hand.

The charge voltage of the capacitor 338 is supplied through the resistor 352 to the base of the transistor 354. The collector of the transistor 354 is connected to the positive terminal 102 of the DC power supply, while the emitter thereof is grounded through the resistors 356 and 358 and the collector-emitter circuit of the transistor 360. The base of the transistor 360 is grounded through the resistor 361. The transistor 363 has a collector, a base and an emitter, of which the collector and the base are connected to the collectors and emitter of the transistor 354 respectively, and the emitter is connected to the junction point of the resistors 358 and 356. The junction point 366 of the transistor 360 and the resistor 358 is connected to the junction point 158 of the comparator 16 through the diode 368.

(10) Ignition timing adjuster

When the potential of the junction 158 in the comparator 16 reaches a predetermined level, say, 3 V, the ignition timing adjuster 56 supplies current to the resistor 361 of the duty adjuster 54, thereby turning on the transistor 360.

The transistor 370 is kept turned on for several hundred μsec after the turning on of the transistor 192 of the amplifier 22. In response to the output of the transistor 370, the ignition timing compensator 56 supplies current to the resistor 361 thereby to turn on the transistor 360 only during the on state of the transistor 370. While the transistor 360 is on, the duty adjusting signal $V_5$ is not supplied to the transistor 140 of the comparator 16.

The collector of the transistor 178 of the amplifier 22 is connected to the ignition timing adjuster 56 through the resistor 372 and the diode 374. The ignition timing adjuster 56 turns off the transistor 360 in response to the output $S_5$ of the amplifier 22.

(11) Noise killer

The collector-emitter circuit of the transistor 380 is inserted between the junction point 158 in the comparator 16 and the junction point 122 in the reference voltage supply circuit 10. The resistor 382 is inserted between the base and emitter of the transistor 380. The collector of the transistor 384 is connected to the positive terminal 102 of the DC power supply through the transistor 386 and the resistor 388, and the emitter of the transistor 384 is connected to the base of the transistor 380.

The emitters and bases of a pair of transistors 390 and 392 are connected to each other respectively, the emitters being further connected via the collector-emitter circuit of the transistor 394 to the positive terminal 102 of the DC power supply, the bases being further connected to the collector of the transistor 392. The collector of the transistor 392 is connected via the resistor 396 to the collector of the transistor 340 in the duty adjuster 54. The base of the transistor 394 is connected to the junction point 118 in the reference voltage supply circuit 10 through the resistor 398.

(12) Constant current device

The constant current device 400 controls at constant level the current flowing through the resistors 402 and 404. As a result, the emitter-collector current of the transistors 130, 174, 184, 222, 264, 328 and 386 of which the base current is maintained substantially constant is also maintained substantially constant.

(13) Operation

By way of explanation, assume that the output signal $V_4$ of the non-saturation time adjuster 52 or the output signal $V_5$ of the duty adjuster 54 is not produced. When the engine is not running, the output voltage of the pick-up coil 86 is zero, and the transistor 142 is turned on and the transistor 140 in the comparator 16 is turned off. A predetermined voltage is produced at the junction point of the zener diode 106 and the resistor 105 of the reference voltage supply circuit 10, and the transistor 108 is in on state. When the transistor 142 is on, the transistor 150 is turned on and therefore the transistor 162 is also turned on. As a result, a voltage drop across the resistor 166 occurs, and the transistor 170 is turned on. Since the transistor 170 is on, the base voltage of the transistor 178 is substantially equal to the earth potential, so that the transistor 178 is kept off. Since the transistor 170 is on, the transistor 126 in the reference voltage supply circuit 10 is also kept off. Under this condition, the forward voltage drop across the diode 114 is determined in such a manner that the predetermined potential $V_{01}$ is attained at the junction point 122 of the resistor 112 and the diode 114 of the reference voltage supply circuit 10. On the other hand, the values of the resistors 110 and 112 are determined in such a manner that the potential $V_{02}$ at the junction point 120 of the resistors 110 and 112 is slightly higher than the potential $V_{01}$. In the description that follows, it is assumed that $V_{01}=1.0$ V and $V_{02}=1.05$ V. In this case, the base potential of the transistor 142 in the comparator 16 is 50 mV higher than the base potential of the transistor 140, so that the transistor 140 is kept off and the transistor 142 kept on.

With the start of the engine, an AC signal voltage $V_3$ as shown in FIG. 3A is generated across the pick-up coil 86. In the drawing, the direction from point A toward point B is considered positive. At time point $T_1$ when the output voltage of the pick-up coil 86 exceeds 50 mV, the base potential of the transistor 140 exceeds the base potential of the transistor 142, so that the collector-emitter circuit of the transistor 140 is formed by the transistor 148 and 144 and the resistor 146. Thus the transistor 140 in the comparator 160 is turned on as shown in FIG. 3B.

With the turning on of the transistor 140, the transistors 142 and 150 are turned off, whereby the transistors 162 and 170 are also restored to off state. When the transistor 170 is turned off, current is supplied to the base of the transistor 178 through the resistor 128, transistor 130, diode 176 and resistor 180, thus turning on the transistor 178. Upon the turning on of the transistor 178, the base potential of the transistor 192 is reduced, so that the transistor 192 is turned off. With the turning off of the transistor 192, the base current of the transistor 202 in the driver circuit 24 is reduced to zero, with the result that the transistor 202 is turned off and the power transistor 32 is turned on. Thus current as shown in FIG. 3C begins to flow in the primary winding 28 of the ignition coil.

When the current begins to flow in the primary winding of the ignition coil, a voltage corresponding to the primary current is generated across the current-detecting resistor 30 connected in series with the primary winding, so that a voltage $V_8$ resulting from dividing a voltage by the current-detecting resistors 42 and 44 is produced at the junction point 235 of the same resistors.

Before the primary winding current reaches a predetermined value, the potential $V_7$ at the junction point of the current-detecting resistors 42 and 44 is lower than the potential at the junction point 238 of the resistor 226 and the diode 228, and therefore the collector-emitter circuit of the transistor 234 is formed by the transistor 224, resistors 240, 242 and 44. Thus the transistor 234 conducts. As a result, no base current flows in the transistor 200 of the driver circuit 24, so that the transistor 200 is in off state.

When the primary winding current increases to the predetermined value, the potential $V_7$ at the junction point of the current-detecting resistors 42 and 44 becomes substantially equal to the potential at the junction point of the resistor 226 and the diode 228, with the result that the base current of the transistor 234 is reduced, thus making transfer to a non-saturated condition (active condition). Thus the collector current of the transistor 234 is decreased, while the collector potential thereof increases. With the increase in the collector potential of the transistor 234, current begins to flow through the bases of the transistors 200 and 202 connected in compound fashion, so that the collector-emitter circuit of the transistor 202 is formed through the positive terminal 102 of the DC power supply and the resistor 204. Thus the base current of the power transistor 32 which is kept turned on in saturated condition is divided by the transistor 202, so that the power transistor 32 transfers to a non-saturated condition. With the transfer of the power transistor 32 to a non-saturated condition, the primary winding current is held at a predetermined level as shown in FIG. 3C. It is disclosed in U.S. Pat. No. 4,030,468 that when the primary current reaches a predetermined value, the power transistor 32 is transferred from saturated to non-saturated condition, thereby holding the primary current at a predetermined value.

At time point $T_2$ in FIG. 3A when the potential at point A of the pick-up coil 86 sharply changes from positive to negative, the base potential of the transistor 140 is reduced below the base potential of the transistor 142, so that the transistor 140 is turned off as shown in FIG. 3B and the transistors 142 and 150 are turned on again. Therefore current flows between the collector and emitter of the transistor 142 through the transistors 150 and 144 and the resistor 146. As a result, the collector potential of the transistor 142 is increased to such a degree that the base current of the transistor 62 begins to flow and the transistor 162 is turned on. With the turning on of the transistor 162, the potential $V_6$ at the input terminal 167 of the amplifier 22 increases, so that the transistor 170 is turned on. As already explained, upon the turning on of the transistor 170, the transistor 192 in the last stage of the amplifier 22 is turned on, with the result that the base current flows in the transistor 202 of the driver circuit 24. The transistor 202 is turned on, while the power transistor 32 is turned off, thus reducing the primary winding current to zero as shown in FIG. 3C. With the turning off of the transistor 32, a high voltage is generated across the secondary winding 34 of the ignition coil, and a spark is discharged at the spark plug 36.

In the process, with the turning on of the transistor 140 of the comparator and the turning off of the transistor 170, the base current is supplied to the transistor 126 of the reference voltage supply circuit through the resistor 128 and the transistor 130. The transistor 126 is thus turned on, thus short-circuiting the resistor 112 through the resistor 125. As a result, the reference voltage $V_2$ of the transistor 142 is reduced by about 50 mV, thereby promoting the turned-on state of the transistor 142. This prevents erroneous operation by a noise produced by the comparator 16.

In the above-mentioned configuration, the transistors 200 and 202 in the driver circuit 24 are connected in compound fashion, the output signal $V_6'$ of the amplifier 22 is applied to the second transistor 202, while the output signal $S_1$ of the current limiter circuit is supplied to the first transistor 200. For this reason, the amplification factor of the circuit comprised of the transistors 200 and 202 is so high that the power transistor 32 is controlled at a non-saturated condition with a very small signal.

As a consequence, the output $S_1$ of the current limiter circuit 38 may be small, thus saving power consumption. According to the circuit of FIG. 2, the value of the resistor 240 may be increased with a decreased power consumption and decreased heat generation. In spite of the fact that the resistor 240 requires the capacity of 70 mW in a well-known circuit, for example, the capacity may be reduced to less than 3.5 mW according to the present invention. It is thus easy to convert the configuration to an integrated circuitry in view of the fact that the total thermal capacity of IC is about 250 mW.

Next, explanation will be made of the operation of the non-saturation time adjuster 52 and the duty adjuster 54.

While the power transistor 32 is in off state or non-saturated state, the collector voltage of the power transistor 32 is so high as to exceed the potential of the junction point of the resistors 270 and 272 in the non-saturation mode detector 50. When the power transistor 32 is in off state, on the other hand, the transistor 178 in the amplifier 22 is turned off, so that current flows in the base-emitter circuit of the transistor 282 through the resistor 182, the transistor 184 and the resistors 284 and 286. Thus the transistors 282 and 288 are turned on, thus reducing the base potential of the transistor 262 to zero. While the power transistor 32 is in off state, therefore, the transistor 262 fails to be turned on even if the base potential of the transistor 260 is higher than the base potential of the transistor 262.

While the power transistor 32 is in non-saturated condition, the transistor 178 in the amplifier 22 is on and therefore the transistors 282 and 288 are off. As a result, the base of the transistor 262 is impressed with the signal $V_7$ corresponding to the collector voltage of the power transistor 32 via the resistor 278 so that the power transistor 32 is turned on. In other words, the transistor 262 is turned on only during the period Ts when the power transistor 32 is in non-saturated condition.

Upon the turning on of the transistor 262, the transistor 276 is turned on, with the result that the transistors 294 and 304 are turned on. The turning on of the transistor 294 causes the transistor 290 to be turned on, so that the junction point 274 of the resistors 272 and 270 is grounded through the resistor 292, thus reducing the potential of the junction point 274. The operation of the transistor 262 is thus stabilized.

With the turning on of the transistor 302, charges are stored in the capacitor 300 connected in series with the transistor 302. Since the current of the transistor 302 is maintained substantially constant, the terminal voltage of the capacitor 300 is substantially proportional to the non-saturation time Ts of the power transistor 32.

The terminal voltage of the capacitor 300 is supplied in the form of non-saturation time adjusting signal $V_4$ to the base of the transistor 142 of the comparator through the resistor 306, the base emitter circuit of the transistor 308, the resistor 310 and the diode 312. Therefore, if the non-saturation time Ts of the power transistor 32 is lengthened, the base voltage of the transistor 142 is increased thus increasing the reference voltage $V_2+V_4$ of the comparator 12. The result is that the conduction start point $T_1$ of the power transistor 32 is delayed, thus shortening the non-saturation time.

The terminal voltage of the capacitor 300 fails to be fed back to the comparator 16 when the power transistor 32 is conducting. More specifically, as long as the power transistor 32 is conducting, the transistor 192 in the amplifier 22 is in off state and therefore the cathode potential of the diode 320 is kept at a high level. The diode 320 is cut off and therefore current flows through the resistor 329, the transistor 328, the diodes 314 and 316 and the resistor 322. The transistor 318 is turned on and the anode side of the diode 312 is grounded, so that the terminal voltage of the capacitor 300 is applied to the comparator 16.

In this way, by preventing the reference voltage of the comparator 16 from being changed when the power transistor 32 is conducting, the power transistor 32 is prevented from being erroneously turned off. That is, the ignition timing is prevented from being changed undesirably.

Upon the turning off of the transistor 192 in the amplifier 22, current flows through the resistor 188, the diode 330, the capacitor 332, the resistor 334, the diode 336 and the capacitor 338, so that the capacitor 338 is charged until the capacitor 332 is completely charged. When the transistor 192 is turned on, on the other hand, charges stored in the capacitor 332 are released through the base-emitter circuit of the transistor 340, the transistor 192, the resistor 190, the grounding terminal 104, the diode 348 and the resistor 334.

In view of the fact that the time constant for charge and discharge of the capacitor 332 is very short as compared with the period of the AC voltage signal $V_3$ generated across the pick-up coil 86, the capacitor 332 charges and discharges completely for each period regardless of the engine r.p.m., i.e., the frequency of the AC voltage signal $V_3$. The charge voltage of the capacitor 332, therefore, is substantially proportional to the charging frequency for the unit time, i.e., engine r.p.m.

The terminal voltage of the capacitor 338 is applied in the form of duty adjusting signal $V_5$ to the base of the transistor 140 of the comparator 16 through the resistor 352, the transistors 354 and 362, the resistor 358 and the diode 368 only when the transistor 360 is kept off. At a high engine revolution speed, therefore, even if the potential at point A of the pick-up coil 86 is reduced to negative, the potential of the transistor 140 is maintained higher than the potential of the transistor 142, and thus the conduction start point of the power transistor 32 is advanced. As a result, even at high engine revolution speed, the primary winding current reaches a predetermined value, thus making it possible to secure a sufficient ignition energy.

It is only during the time when transistor 360 is in off state that the terminal voltage of the capacitor 338 is applied in the form of the duty adjusting signal $V_5$ to the base of the transistor 140. The transistor 360 is controlled by the ignition timing compensator 56 and kept on only when the output voltage of the AC voltage source 12 exceeds a predetermined value or only for several hundred μsec following the generation by the amplifier 22 of a signal turning off the power transistor 32.

In other words, when the cathode potential of the diode 368 exceeds a predetermined value, the ignition timing compensator 56 produces an output and the transistor 360 is turned on, so that the terminal voltage of the capacitor 338 fails to be applied to the base of the transistor 140. Therefore, even if the engine r.p.m. is increased, the time point $T_2$ when the potential of the transistor 140 of the comparator 16 is reduced below the reference voltage of the transistor 142 remains the same. Thus even when the engine r.p.m., changes, the ignition timing is maintained the same.

As explained above, the transistor 390 is kept on during the period of several hundred μsec required for discharge of the capacitor 172 after the turning on of the transistor 192 in the amplifier 22. During the same period, the transistor 384 is also turned on, thus turning on the transistor 380. During the period of several hundred μsec after the turning on of the transistor 192, therefore, the terminals of the pick-up coil 86 are shorted by the transistor 380, so that the base potential of the transistor 140 of the comparator 16 is maintained at low level.

The spark plug 36 is started several hundred μsec after the turning on of the transistor 140 of the comparator 16. Upon the starting of the spark plug 36, positive and negative noise voltages are superimposed on each other at the pick-up coil 86 for several tens of μsec. At time of generation of the noises, the voltage of the pick-up coil 86 is directed toward negative and this negative component of the noises stabilizes the off state of the transistor 140. The positive component of the noises, on the other hand, makes the off state of the transistor 140 unstable, thus contributing to the erroneous operation of the transistor 140.

In the above-mentioned embodiment, for the period of several hundred μsec after the turning on of the transistor 192, the output terminals of the pick-up coil 86 are kept shorted and therefore even if the above-mentioned noises are generated, the transistor 140 is prevented from being erroneously operated.

What is claimed is:

1. In an ignition system for an internal combustion engine, comprising an ignition coil including a primary winding and a secondary winding, and a DC power supply, the improvement further comprising:

means for generating an ignition timing signal in synchronism with the r.p.m. of said internal combustion engine;

an amplifier connected to the output terminal of said ignition timing signal generator means;

a driver circuit including first and second transistors, each of said first and second transistors including a collector, an emitter and a base, the collectors of said first and second transistors being connected to each other, the emitter of said first transistor being connected to the base of said second transistor, the base of said second transistor being connected to the output terminal of said amplifier;

a power transistor connected in series to the primary winding of said ignition coil, the base of said power transistor being connected to the collector of said second transistor, said power transistor being placed in selected one of on state, off state and non-saturated state according to the output level of said second transistor, said power transistor causing a current to flow from said DC power supply through said primary winding when said power transistor is in on state, said power transistor cutting off said current from said DC power supply when said power transistor is in off state, said power transistor limiting said current in said primary winding to a predetermined value when said power transistor is in non-saturated state;

a current detector operated in response to the current flowing through said primary winding; and a current limiter circuit connected to the output terminal of said current detector, the output terminal of said current limiter circuit being connected to the base of said first transistor of said driver circuit, said current limiter circuit causing a current to flow to the base of said first transistor and thereby to change the output level of said second transistor when said current in said primary winding reaches a predetermined value, thus turning on said power transistor in non-saturated state.

2. An ignition system for the internal combustion engine according to claim 1, wherein said driver circuit includes means for negatively feeding back the collector-emitter current of said first transistor to said current limiter circuit.

3. In an ignition system for an internal combustion engine, comprising an ignition coil including a primary winding and a secondary winding and a DC power supply, the improvement further comprising:

a pick-up coil for generating an AC voltage signal in synchronism with the r.p.m. of said internal combustion engine;

a comparator circuit connected to the output terminal of said pick-up coil, said comparator circuit comparing said AC voltage signal with a reference voltage and producing a rectangular wave output corresponding to said AC voltage signal, the width of said rectangular wave output being determined by the magnitude of said reference voltage;

an amplifier connected to the output terminal of said comparator circuit;

a driver circuit connected to the output terminal of said amplifier;

a power transistor connected in series to said primary winding of said ignition coil, the base of said power transistor being connected to the output terminal of said driver circuit, said power transistor being placed in selected one of on state, off state and non-saturated state according to the output level of said driver circuit, said power transistor being placed in on state or non-saturated state during the period when said rectangular wave output is produced from said comparator circuit, said power transistor causing a current to flow through said primary winding from said DC power supply when said power transistor is in on state, said power transistor cutting off said current from said DC power supply when said power transistor is in off state, said power transistor limiting the current in said primary winding to a predetermined value when said power transistor is in non-saturated state;

a current detector for generating an output signal corresponding to the current flowing in said primary winding;

a current limiter circuit connected to the output terminal of said current detector, the output terminal of said current limiter circuit being connected to the input terminal of said driver circuit, said current limiter circuit changing the output level of said driver circuit when the current flowing in said primary winding reaches said predetermined value, thus causing said power transistor to be turned on in non-saturated state;

means for generating an output corresponding to the time during which said power transistor is operated in non-saturated state, said means including a constant current circuit for supplying a predetermined current and a capacitor charged through said constant current circuit during said non-saturation time and generating a voltage associated with said non-saturation time;

a non-saturation time adjuster circuit for applying the terminal voltage of said capacitor to said comparator when said power transistor is in off state, said comparator changing the reference voltage according to the terminal voltage of said capacitor, thereby adjusting the width of said rectangular wave output signal in such a manner that the non-saturation time of said power transistor is shortened; and means for preventing said terminal voltage of said capacitor from being applied to said comparator when said power transistor is in on state.

4. An ignition system for an internal combustion engine according to claim 3, wherein said pick-up coil includes a noise killer circuit connected across the terminals of said pick-up coil, said noise killer shorting said pick-up coil for a predetermined period of time when said power transistor transfers from non-saturated state to off state.

* * * * *